US007143557B1

(12) United States Patent
Ayers, Jr.

(10) Patent No.: US 7,143,557 B1
(45) Date of Patent: Dec. 5, 2006

(54) STRUCTURAL VENT ASSEMBLY FOR A ROOF PERIMETER

(76) Inventor: W. Howard Ayers, Jr., 5800 Cowley La., McCalla, AL (US) 35111

( * ) Notice: Subject to any disclaimer, the term of this patent is extended or adjusted under 35 U.S.C. 154(b) by 263 days.

(21) Appl. No.: 10/328,592

(22) Filed: Dec. 23, 2002

Related U.S. Application Data

(60) Provisional application No. 60/344,996, filed on Jan. 4, 2002.

(51) Int. Cl.
*E04B 1/70* (2006.01)

(52) U.S. Cl. ..... 52/302.1; 52/95; 52/199; 52/408; 454/250; 454/260; 454/365

(58) Field of Classification Search ..... 52/95, 52/94, 198, 199, 502.1, 783.19, 716.2, 717.06, 52/404, 410, 478, 302.3, 408; 434/185, 186, 434/250, 260, 365
See application file for complete search history.

(56) References Cited

U.S. PATENT DOCUMENTS 1,028,725 A * 6/1912 Hodgson ..... 52/22
2,214,183 A * 9/1940 Seymour ..... 52/95
2,645,824 A * 7/1953 Titsworth ..... 52/302.3
3,368,473 A * 2/1968 Sohda et al. ..... 454/185
3,435,976 A * 4/1969 Owens ..... 215/329
3,633,659 A * 1/1972 Ohlsson ..... 165/56
3,797,180 A * 3/1974 Grange ..... 52/95
3,797,181 A * 3/1974 Nievelt ..... 52/105
3,972,164 A * 8/1976 Grange ..... 52/95
4,214,510 A * 7/1980 Ward ..... 454/260
4,295,415 A 10/1981 Schneider, Jr.
4,371,031 A * 2/1983 Bernander et al. ..... 165/54
4,379,381 A * 4/1983 Holcombe ..... 52/404.3
4,382,435 A * 5/1983 Brill-Edwards ..... 126/622
4,423,572 A * 1/1984 Tor ..... 52/94
4,429,503 A * 2/1984 Holliday ..... 52/410
4,435,926 A * 3/1984 Struben ..... 52/3
4,446,661 A * 5/1984 Jonsson et al. ..... 52/95
4,570,396 A * 2/1986 Struben ..... 52/90.2
4,635,419 A * 1/1987 Forrest ..... 52/302.3
4,642,958 A * 2/1987 Pewitt ..... 52/302.3
4,677,903 A * 7/1987 Mathews, III ..... 454/185
4,736,561 A * 4/1988 Lehr et al. ..... 52/410
4,783,942 A * 11/1988 Nunley et al. ..... 52/309.1
4,852,314 A * 8/1989 Moore, Jr. ..... 52/199
4,890,427 A * 1/1990 Rayburn ..... 52/90.2
4,977,714 A * 12/1990 Gregory, Jr. ..... 52/95
5,335,462 A * 8/1994 Park ..... 52/95
5,347,768 A * 9/1994 Pineda ..... 52/23
5,433,050 A * 7/1995 Wilson et al. ..... 52/302.1
5,473,847 A * 12/1995 Crookston ..... 52/302.1
5,487,247 A * 1/1996 Pigg ..... 52/302.3
5,586,414 A * 12/1996 Tawzer ..... 52/57

(Continued)

*Primary Examiner*—Naoko Slack
*Assistant Examiner*—Yvonne M. Horton
(74) *Attorney, Agent, or Firm*—Kenneth M. Bush; Bush IP Law Group, LLC

(57) ABSTRACT

A structural vent assembly comprising a back member having a forward surface and a rear surface; a mount member adapted to be secured to the support structure between the roof deck and the support structure, the mount member having a proximal end fixedly attached to the rear surface; a front member having an outer surface and an inner surface; and means for connecting the forward surface to the inner surface in spaced apart relationship to form a passage for air flow therebetween, the passage having an upper end and a lower end communicating with the air space of the roof deck.

28 Claims, 4 Drawing Sheets

U.S. PATENT DOCUMENTS 5,761,864 A * 6/1998 Nonoshita ..... 52/302.3
6,023,922 A * 2/2000 Lancaster ..... 56/200
6,061,978 A 5/2000 Dinwoodie et al.
6,088,992 A * 7/2000 Nunley ..... 52/783.19
6,185,895 B1 * 2/2001 Rettew ..... 52/528
6,780,099 B1 * 8/2004 Harper ..... 454/186

* cited by examiner

STRUCTURAL VENT ASSEMBLY FOR A ROOF PERIMETER

This application claims priority from U.S. Provisional Application No. 60/344,996, filed on Jan. 4, 2002.

FIELD OF THE INVENTION

The present invention relates to roofing components, and more particularly, to roofing ventilation systems. With even more particularity, the present invention relates to improved vent assemblies for the perimeter of roof systems having vented roof decks.

BACKGROUND OF THE INVENTION

Roof systems typically comprise a roof deck system utilized to support a roof membrane such as shingles. The roof deck system of a commercial building is typically comprised of a metal deck such as a sheet of corrugated steel mounted on a roof deck support structure such as steel or wooden roof beams. The metal deck supports insulation that, in turn, supports a wood member such as oriented strand board ("OSB") or plywood. This wood member provides the support surface for the roof membrane. A problem found with such prior art roof deck systems is that heat and moisture tend to penetrate into the wood member and, as a result of inadequate ventilation, the wood member deteriorates thereby causing premature failure of the roof membrane.

In response to this problem, an improvement to roof deck systems has been the incorporation of a venting system within the roof deck system that removes moisture and excess heat from the wood member. In this system, spacers are placed between the above described wood member and insulation, to form channels that preferable open along the roof ridge and eaves to allow air to flow freely between the wood member and the insulation. Proper ventilation provides a mechanism for maintaining the roof decking and roof membrane in good condition without moving parts or energy consumption.

One problem with this improvement is that there are no uniform vented eave designs. As a result, architects, engineers, and builders must perform custom designs that are on-site labor intensive, causing a significant increase in construction expense. The on-site nature of the design and construction of conventional vented eave systems reduces the quality of the finished product because it is not manufactured under controlled conditions. In addition to difficulties associated with construction, conventional vented eaves have not been designed to provide stable support for gutters, finished fascia material, soffit panels, and other components of roof deck perimeters. Conventional vented eaves also make use of wood building materials, and thus suffer problems inherent with such materials such as rotting, warping, burning, shrinking, and being subject to attack by termites. Further, steel angles used for roof deck support cause the deck to slope slightly upwards at the roof edge, thereby causing a "ski slope condition" which results in the finished roof surface being out of plane.

From the foregoing it may be seen that heretofore, no one has adequately provided a structural vent assembly for use along the perimeter of a roof with a vented roof deck. A need exists for a structural vent assembly that is easy to install and eliminates the need for expensive, complicated, and field labor intensive custom design procedures, as well as provides stable structural support for components of roof deck perimeters. Accordingly, there is a need for a uniform structural vent assembly that overcomes the limitations of prior art eave vent assemblies.

SUMMARY OF THE PRESENT INVENTION

It is an object of the present invention to provide an improved roof ventilation system.

A further object of the present invention is to provide an improved structural vent assembly for use with a roof perimeter having a vented roof deck.

Another object of the present invention is to provide a structural vent assembly for use with a roof perimeter that is easy to install and does not require complicated, expensive, and field labor intensive custom design procedures.

A still further object of the present invention is to provide a structural vent assembly that provides stable structural support for components of a roof perimeter.

Another object of the present invention is to provide a structural vent assembly that does not rely on wood or other types of building materials that are subject to rotting, warping, burning, shrinking or to being attacked by termites.

An additional object of the present invention is to provide a structural vent assembly for a roof perimeter that is strong enough to withstand stresses between the roof deck and the roof deck supporting structure.

These and other objects of the present invention are accomplished through the use of a structural vent assembly for use along the perimeter of a roof comprising a vented roof deck and a roof deck support structure. The structural vent assembly of the present invention is preferably a single, prefabricated assembly ready for field installation during building construction in a one-step procedure. The present invention comprises a structural vent assembly having the components of a back member with a forward surface and a rear surface; a mount member adapted to be secured to the roof support system structure between a vented roof deck and a roof deck support structure. The mount member of the present invention has a proximal end fixedly attached to the rear surface of the back member. The present invention further comprises a front member, and means for connecting the back member and front member in spaced apart relationship to provide an air passage therethrough for air flow between a lower end and an upper end of the air passage, which are in communication with the air space of a vented roof deck. The vent assembly of the present invention provides an air passage which allows outside air to flow from a vented soffit to a vented roof deck or, alternatively, into roof deck systems without soffits.

In one embodiment, the present invention allows outside air to flow from a vented soffit panel, through an air passage in the unit, and into a vented roof deck system. Further, the present invention ties the eave ends of the building structure together and provides structural support for the perimeter of a roof deck. Preferably the back member of the present invention and mount member of the present invention are comprised of an upper and a lower bent plate each with a leg, one extending upward and the other extending downward, which form the back side of the air passage of the present invention. The front or fascia side of the present invention is attached to the back side of the present invention with spacing members such as zee purlins thereby forming the air passage. The front side of the present invention provides stable support for gutters, finished fascia material and soffit panels. The unit is preferably comprised entirely of steel to eliminate the use of wood due to the numerous problems encountered with wood building materials such as rotting, warping, burning, shrinking, and being attacked by termites. The present invention provides architects, engineers, and builders with an improved one-piece solution that eliminates the need for custom design procedures. The present invention may be installed quickly and easily, thereby greatly improving field productivity. The present invention may also be manufactured in a factory-controlled environment which, compared to on-site custom design and manufacturing techniques, produces a higher quality product less expensively.

These and other objects and advantages of the invention will become apparent from the following detailed description of the preferred embodiment of the invention.

BRIEF DESCRIPTION OF THE DRAWINGS

A structural vent assembly for use along the perimeter of a roof embodying the features of the present invention is depicted in the accompanying drawings which form a portion of this disclosure and wherein.

DESCRIPTION OF THE PREFERRED EMBODIMENT

Figure 1:
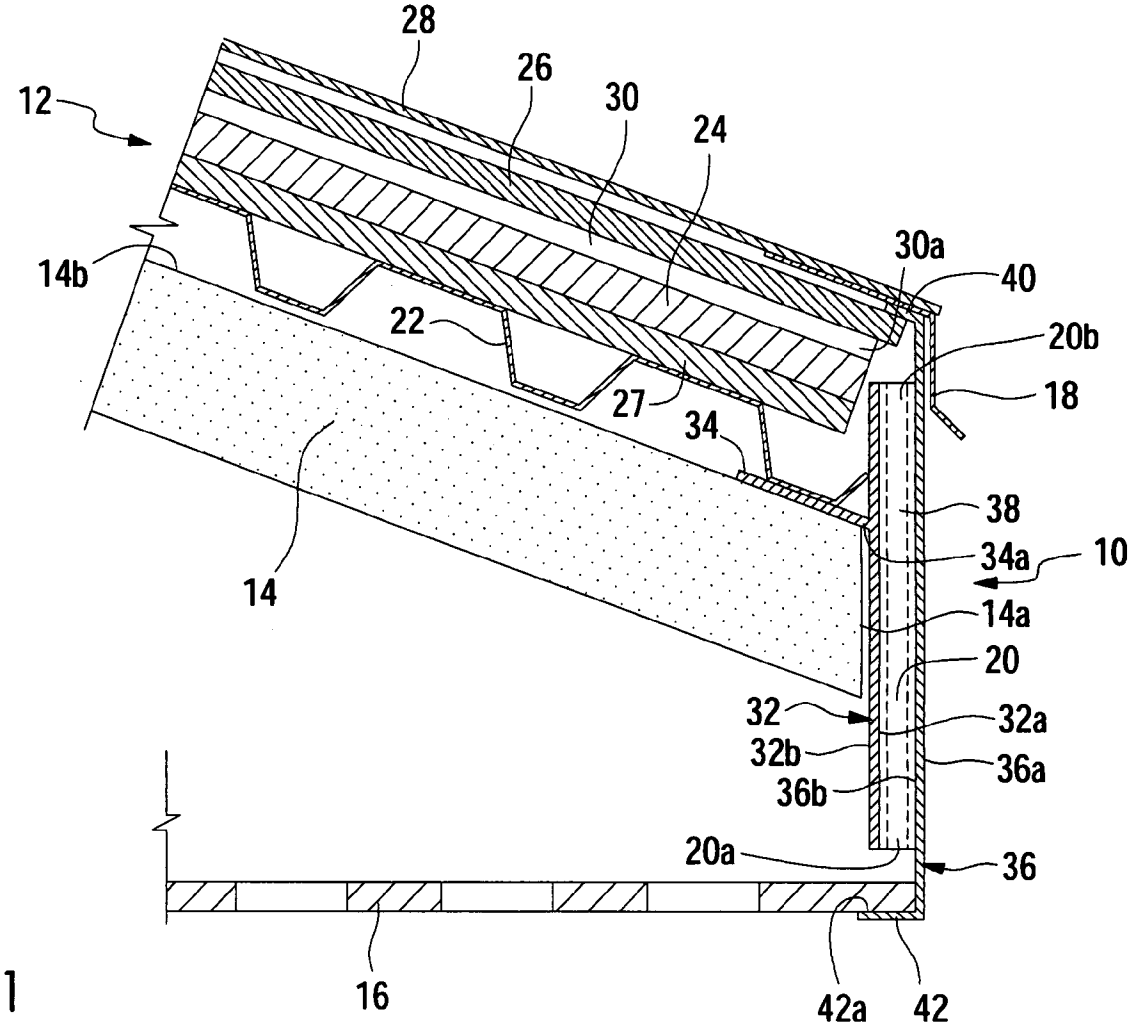
FIG. 1 is a side elevational view of an embodiment of the present invention incorporated into a roof system having a soffit panel.
Figure 2:
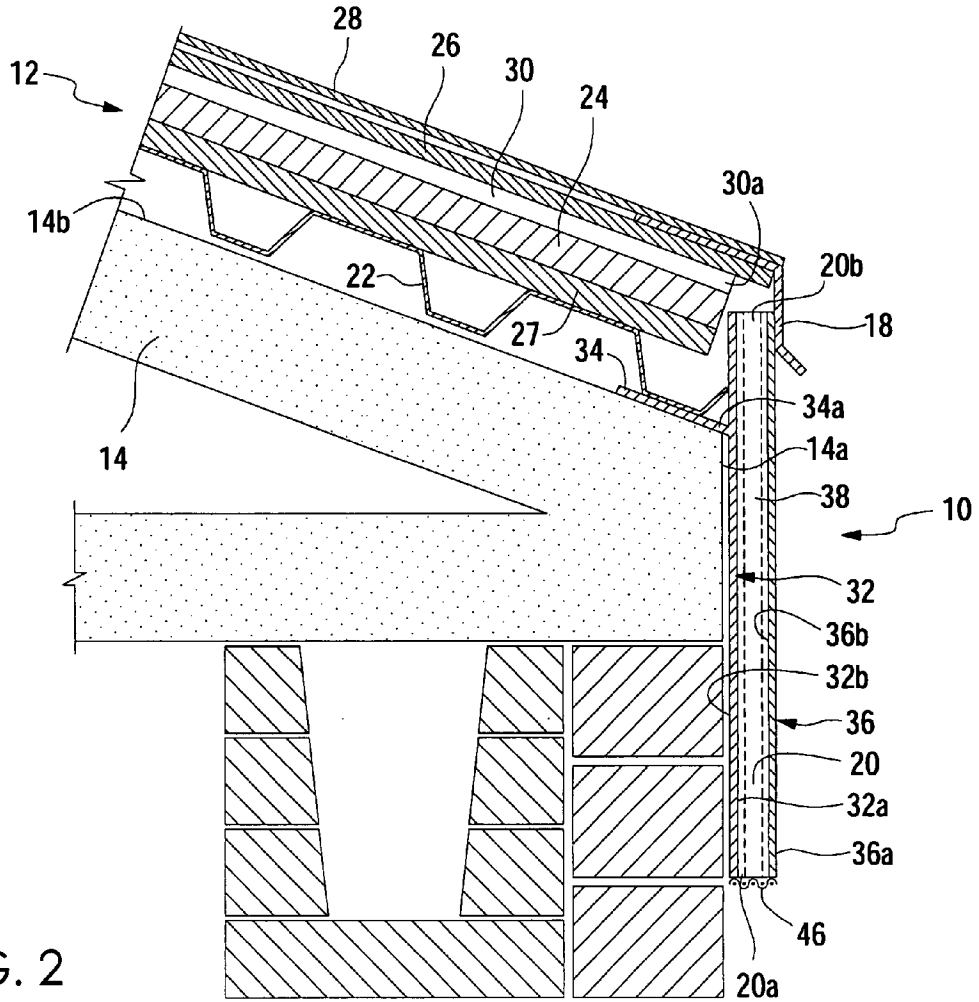
FIG. 2 is a side elevational view of another embodiment of the present invention incorporated into a roof system not having a soffit panel.
Figure 3:
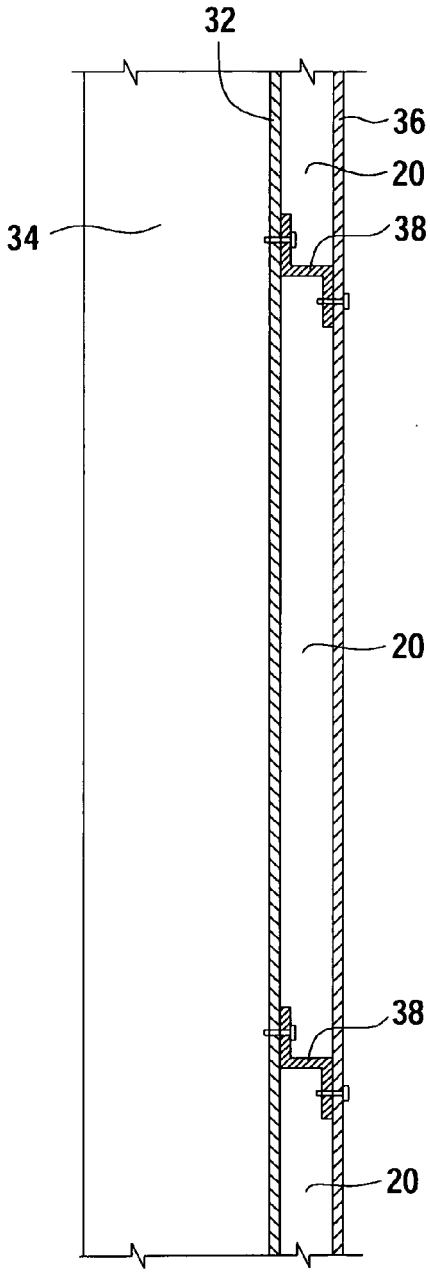
FIG. 3 is a top plan view of the embodiment of the present invention of FIG. 2.

Referring to the FIGS. 1–5 for a clearer understanding of the invention, it may be seen that the invention contemplates a vented roof system having a structural vent assembly 10 for use along the perimeter of a roof comprising a vented roof deck 12 and a roof deck support structure 14. The structural vent assembly 10 of the present invention is preferably a single, prefabricated assembly ready for field installation during building construction in a one-step procedure. The preferred embodiment of the vent assembly 10 provides an air passage 20 which allows outside air to flow from a vented soffit 16 to a vented roof deck 12 as shown in FIG. 1. Alternatively, the vent assembly 10 of the present invention may be utilized for roof systems not having a soffit panel, such as the roof system shown in FIG. 2. As shown in FIGS. 1 and 2, the vent assembly 10 is shown providing structural support for metal flashing 18; however, the present invention may be utilized to provide structural support for flashing having other configurations, or other roof, deck perimeter components (not shown), as needed or desired, such as gutters, downpipes, fascia, or cladding.

The vented roof system of the present invention comprises a roof deck support structure 14 having an edge 14*a* intersecting an upper surface 14*b* at a corner. The vented roof deck 12 comprises a corrugated metal sheet 22 supported on the upper surface 14*b* of the support structure, at least one sheet of insulation 24 above the corrugated sheet 22, a first sheet of rigid material 26 such as oriented strand board ("OSB"), gypsum board, or plywood, and a roof membrane 28 such as but not limited to shingles affixed to a top surface of the first sheet of rigid material 26. The components of the vented roof deck 12 are affixed to one another by attachment means (not shown) well known in the art, including but not limited to threaded fasteners, roof deck fasteners, or plug or tack welds. The roof deck 12 further comprises means for positioning the first sheet of rigid material 26 above the sheet of insulation 24 to provide a roof deck air space 30 therebetween for venting the roof deck 12. The air space 30 has an outer end 30*a* positioned along the perimeter of the roof deck 12. The roof deck 12 may further comprise additional layers of material, as needed, such as a second sheet of rigid material 27 interposed between the corrugated sheet of material 22 and the sheet of insulation 24 as shown in FIGS. 1 and 2, or additional sheets of insulation. It is contemplated that the vent assembly 10 of the present invention may be utilized to provide ventilation for other types of vented roof decks 12 known in the art, and the present invention is not intended for use only with roof decks 12 having the components and configurations described herein.

As shown in FIGS. 1 and 2, the structural vent assembly 10 comprises a back member 32 having a forward surface 32*a* and a rear surface 32*b*, a mount member 34 adapted to be secured to the roof support structure 14 between the roof deck 12 and an upper surface 14*b* of the support structure. The mount member 34 has a proximal end 34*a* fixedly attached to the rear surface 32*b* of the back member 32. The vent assembly 10 further comprises a front member 36 having an outer surface 36*a* and an inner surface 36*b*, and means for connecting the forward surface 32*a* to the inner surface 36*b* in spaced apart relationship to form an air passage 20 therebetween for air flow. The upper end 20*b* and lower end 20*a* of the passage are in communication with the air space 30 of the roof deck 12. The components of the structural vent assembly 10 are preferably comprised of strips of sheet metal, preferably galvanized steel so that the components do not buckle or warp from aging.

The structural vent assembly 10 of the present invention further comprises means for connecting the back member 32 and front member 36, such as a plurality of spacing members having a first end fixedly attached to the forward surface 32*a* and a second end fixedly attached to the inner surface 36*b*. In the preferred embodiment, the spacing members 38 are elongated zee purlins connected at a first end to the back member 32 and at a second end to the front member 36. It can be appreciated with reference to FIG. 3, a top view of an embodiment of the present invention, that the structural vent assembly 10 allows air flow between the upper 20*b* and lower 20*a* ends of the passage.

In the preferred embodiment, the back member 32, mount member 34, and front member 36 are planar. Further, the front member 36 and back member 32 are positioned in parallel relationship as allowed for by the use of spacing members 38 in the form of zee purlins. The mount member 34 is adapted to extend generally parallel to the upper surface 14*b* of the support structure and the back member 32 extends generally parallel to the edge 14*a* of the support structure. FIGS. 1 and 2 show use of the present invention with a roof support structure 14 having an inclined upper surface 14*b* and a generally vertical edge 14*a*. Accordingly, the preferred embodiment of the present invention provides for the back member 32 and front member 36 to be positioned in a generally vertical position, with the mount member 34 intersecting the back member 32 at an inclined angle as required to support the mount member 34 on the upper surface 14*b* of the roof support structure and also vertically position the back member 32 and front 36 member. The angle of intersection of the mount member 34 and the lower portion of the back member 32 corresponds to an obtuse angle defined by an angle of intersection of the upper surface 14*b* of the support member and the edge 14*a* of the support member. The angle of intersection of the mount member 34 and the upper portion of the back member 32 is an acute angle required to maintain the back member 32 in vertical, or coplanar relationship.

Figure 4:
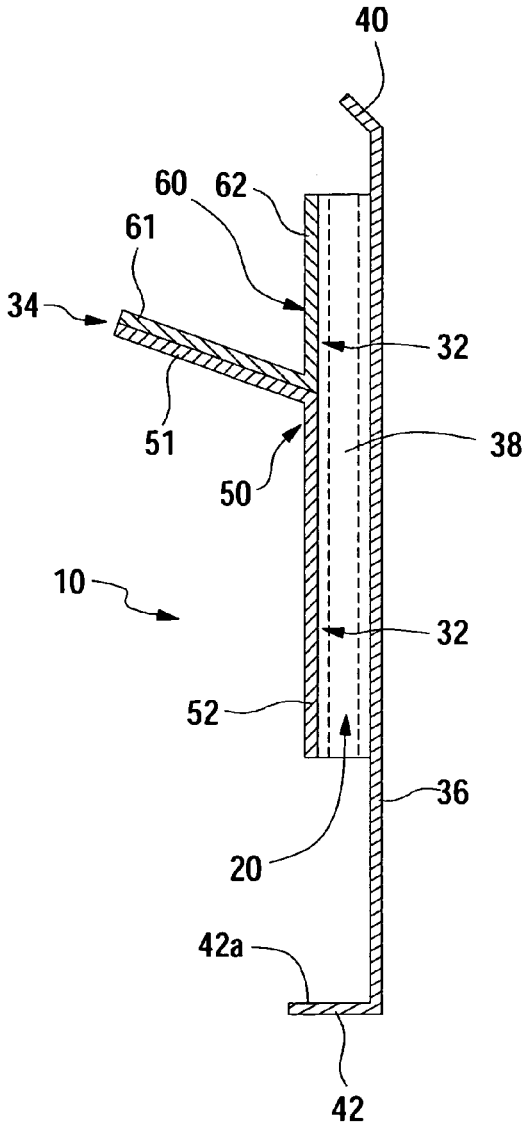
FIG. 4 is a side elevational view of the preferred embodiment of the present invention.
Figure 5:
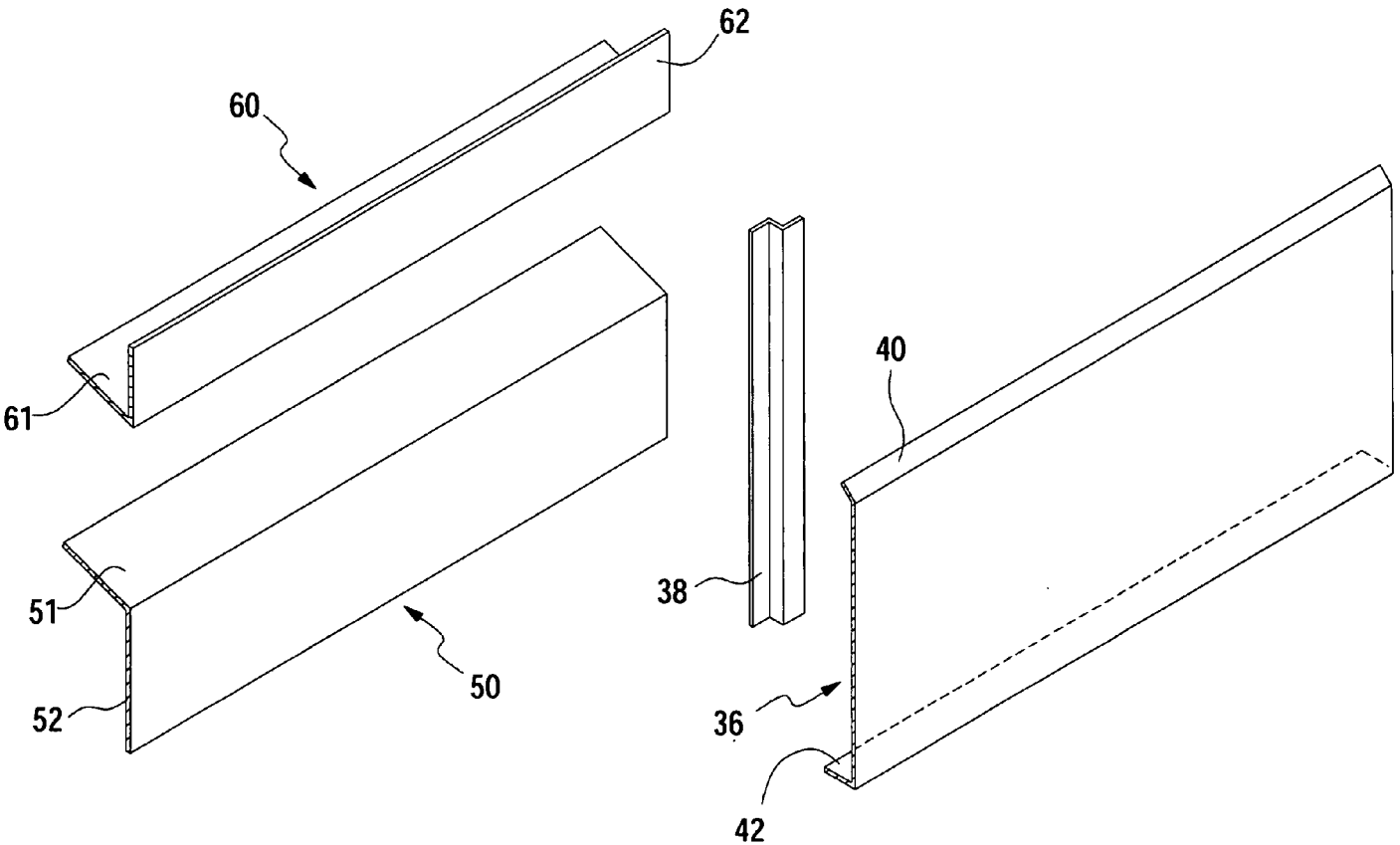
FIG. 5 is an exploded perspective view of the embodiment of the present invention of FIG. 4.

In the embodiments of the present invention shown in FIGS. 1, 4 and 5, the structural vent assembly 10 further comprises a lip member 40 extending from the top end of the front member 36 and into the roof deck 12 so that the distal end of the lip 40 is interposed between the first sheet of rigid material 26 and the roof membrane 28, as shown in FIG. 1. These embodiments of the structural vent assembly 10 also provide a soffit support member 42 extending from the bottom end of the front member 36. The soffit support member 42 has an upper surface 42*a* adapted for supporting engagement with a distal end of a vented soffit 44, and the front member 36 and soffit support member 42 may be generally orthogonal as shown in FIGS. 1, 4 and 5. It can be appreciated with reference to FIG. 1 that that vented soffit 16 is in communication with the lower end 20*a* of the passage 20. In an alternate embodiment for use with a roof system without a soffit as shown in FIG. 2, the invention may be further provided with a screen 46 attached to the lower ends of the back member 32 and front member 36 to enclose the lower end 20*a* of the passage 20.

In the preferred embodiment, as shown in sectional view in FIG. 4 and in an exploded perspective view in FIG. 5, the preferred embodiment of the structural vent assembly 10 of the present invention has a mount member 34 and a back member 12 that are comprised of a lower bent plate 50 and an upper bent plate 60. The lower bent plate 50 has a first leg 51 forming or corresponding to a lower portion of the mount member 34, and a second leg 52 forming a lower portion of the back member 32. The upper bent plate 60 has a first leg 61 forming an upper portion of the mount member 34, and a second leg 62 forming an upper portion of the back member 32. The first leg 61 of the upper bent plate 60 overlies the first leg 51 of the lower bent plate 50 and is connected thereto to form the mount member 34. The second leg 52 of the lower bent plate 50 and the second leg 62 of the upper bent plate 60 are aligned in a coplanar relationship to form the vertically positioned back member 32. To accommodate roof deck support structures having an inclined or horizontal upper surface such as the roof deck support structure 14 shown in FIGS. 1 and 2, the present invention contemplates an upper bent plate 60 having a first leg 61 and a second leg 62 connected at an angle to one another of between about twenty degrees to about ninety degrees.

It should be understood that the present invention may be used in conjunction with roof perimeter components such as gutters (not shown) and flashing as needed or desired. It is also contemplated that the present invention may be utilized to achieve similar results with different roofing configurations other than those structures disclosed in FIGS. 1 and 2. Although a composite roof deck assembly and roof deck support structure having specific configurations and comprised of specific materials are described herein, it is contemplated that the structural vent assembly of the present invention may be utilized with roofs constructed of other materials and having different configurations. It is contemplated that the structural vent assembly of the present invention will be utilized with materials and configurations conventionally used for commercial and residential roof construction.

It is to be understood that the form of the invention shown is a preferred embodiment thereof and that various changes and modifications may be made therein without departing from the spirit of the invention or scope as defined in the following claims.

What is claimed is:

1. A structural vent assembly for a perimeter of a roof, the roof including a vented roof deck mounted on a roof deck support structure, the support structure having an outer surface intersecting an upper surface of the support structure at a corner, said vent assembly comprising:

a back member having a forward surface and a rear surface;

a mount member having a proximal end fixedly attached to said rear surface and a distal end extending rearwardly therefrom, wherein said mount member is secured to the support structure between the roof deck and the support structure such that said mount member extends generally parallel to the upper surface of the support structure and said back member extends generally parallel to the outer surface of the support structure;

a front member having an outer surface and an inner surface; and means for connecting said forward surface to said inner surface in spaced apart relationship to form a passage for air flow therebetween.

2. A structural vent assembly as described in claim 1 wherein said means for connecting comprises a plurality of spacing members having a first end fixedly attached to said forward surface and a second end fixedly attached to said inner surface.

3. A structural vent assembly for a perimeter of a roof, the roof including a vented roof deck mounted on a roof deck support structure, the support structure having an outer surface intersecting an upper surface of the support structure at a corner, said vent assembly comprising:

a back member having a forward surface and a rear surface;

a mount member secured to the support structure between the roof deck and the support structure, said mount member having a proximal end fixedly attached to said rear surface;

a front member having an outer surface and an inner surface; and a plurality of spacing members for connecting said forward surface to said inner surface in spaced apart relationship to form a passage for air flow therebetween, each of said spacing members having a first end fixedly attached to said forward surface and a second end fixedly attached to said inner surface, wherein said spacing members comprise purlins.

4. A structural vent assembly as described in claim 3 wherein said back member, said mount member, and said front member are planar.

5. A structural vent assembly as described in claim 4 wherein said front member and said back member are generally parallel.

6. A structural vent assembly as described in claim 5 wherein said mount member extends generally parallel to the upper surface of the support structure and said back member extends generally parallel to the outer surface of the support structure.

7. A structural vent assembly as described in claim 5 wherein said front member has a top end and said vent assembly further comprises a lip member extending from said top end into the roof deck.

8. A structural vent assembly as described in claim 5 wherein said back member and said front member have lower ends and said vent assembly further comprises a screen attached to said lower ends.

9. A structural vent assembly as described in claim 5 wherein said front member has a lower end and said vent assembly further comprises a soffit support member extending from said lower end, wherein said front member and said soffit support member are generally orthogonal.

10. A structural vent assembly as described in claim 5 wherein said mount member and said back member are comprised of a lower bent plate and an upper bent plate, said lower bent plate having a first leg forming a lower portion of said mount member and a second leg forming a lower portion of said back member, said upper bent plate having a first leg overlying said first leg of said lower bent plate and connected thereto to form an upper portion of said mount member, and a second leg forming an upper portion of said back member and positioned coplanar with said second leg of said lower bent plate.

11. A structural vent assembly as described in claim 10 wherein said first leg and said second leg of said upper bent plate connect at an angle to one another of between about twenty degrees to about ninety degrees.

12. A structural vent assembly as described in claim 10 wherein said first leg of said lower bent plate extends generally parallel to the upper surface of the support structure and said second leg of said lower bent plate extends generally parallel to the outer surface of the support structure.

13. A vented roof system, comprising:

a roof deck support structure having an edge, said edge intersecting an upper surface of said support structure at a corner;

a roof deck having a corrugated sheet supported on said upper surface of said support structure, at least one sheet of insulation above said corrugated sheet, a first sheet of rigid material, a roof covering above said first sheet of rigid material and affixed thereto, and means for positioning said first rigid sheet above said at least one sheet of insulation to provide an air space therebetween for venting said roof deck, said air space having an outer end; and a structural vent assembly comprising a back member having a forward surface and a rear surface; a mount member secured to said support structure between said roof deck and said support structure, said mount member having a proximal end fixedly attached to said rear surface, a front member having an outer surface and an inner surface, and means for connecting said forward surface to said inner surface in spaced apart relationship to form a passage for air flow therebetween, said passage having an upper end and a lower end communicating with said air space of said roof deck.

14. A vented roof system as described in claim 13 wherein said means for connecting comprises a plurality of spacing members having a first end fixedly attached to said forward surface and a second end fixedly attached to said inner surface.

15. A vented roof system as described in claim 14 wherein said spacing members comprise purlins.

16. A vented roof system as described in claim 15 wherein said back member, said mount member, and said front member are planar.

17. A vented roof system as described in claim 16 wherein said front member and said back member are generally parallel.

18. A vented roof system as described in claim 16 wherein said roof deck further comprises a second sheet of rigid material interposed between said corrugated sheet and said at least one sheet of insulation.

19. A vented roof system as described in claim 16 wherein said mount member extends generally parallel to said upper surface of said support structure and said back member extends generally parallel to said edge of said support structure.

20. A vented roof system as described in claim 16 wherein said front member has a top end and said vent assembly further comprises a lip member extending from said top end into said roof deck interposed between said first sheet of rigid material and said roof covering.

21. A vented roof system as described in claim 16 wherein said back member and said front member have lower ends and said vent assembly further comprises a screen attached to said lower ends.

22. A vented roof system as described in claim 16 further comprising a vented soffit in communication with said passage.

23. A vented roof system as described in claim 22 wherein said structural vent assembly further comprises a soffit support member having an upper surface adapted for connection to a distal end of said vented soffit, wherein said front member and said soffit support member are generally orthogonal.

24. A vented roof system as described in claim 16 wherein said mount member and said back member are comprised of a lower bent plate and an upper bent plate, said lower bent plate having a first leg forming a lower portion of said mount member and a second leg forming a lower portion of said back member, said upper bent plate having a first leg overlying said first leg of said lower bent plate and connected thereto, said first leg of said upper bent plate forming an upper portion of said mount member, and a second leg forming an upper portion of said back member and positioned coplanar with said second leg of said lower bent plate.

25. A vented roof system as described in claim 24 wherein said first leg and said second leg of said upper bent plate connect at an angle to one another of between about twenty degrees to about ninety degrees.

26. A structural assembly for a perimeter of a roof, the roof including a vented roof deck mounted on a roof deck support structure, the support structure having an edge intersecting an upper surface of the support structure at a corner, said structural assembly comprising:

a front member having an outer surface and an inner surface;

a back member having a forward surface and a rear surface;

at least one connecting member for connecting said front member inner surface to said back member forward surface in spaced apart relationship; and a mount member having a proximal end fixedly attached to said back member rear surface such that said back member has an upper portion above said proximal end and a lower portion below said proximal end, wherein the angle between said upper portion and said mount member is between about twenty degrees to about ninety degrees, and wherein said mount member is secured to the support structure between the roof deck and the support structure.

27. A structural assembly as described in claim 26 wherein said mount member extends generally parallel to the upper surface of the support structure and said back member lower portion extends generally parallel to the edge of the support structure.

28. A structural assembly as described in claim 26 wherein said mount member and said back member are comprised of a lower bent plate and an upper bent plate, said lower bent plate having a first leg forming a lower portion of said mount member and a second leg forming said lower portion of said back member, said upper bent plate having a first leg overlying said first leg of said lower bent plate and connected thereto to form an upper portion of said mount member, and a second leg forming said upper portion of said back member and positioned coplanar with said second leg of said lower bent plate.

* * * * *